United States Patent [19]

Austin

[11] 4,298,152

[45] Nov. 3, 1981

[54] ACCUMULATOR FOR TENUOUS MATERIAL

[75] Inventor: Robert C. Austin, Deerfield, Ohio

[73] Assignee: Weld-Loc Systems, Inc., Alliance, Ohio

[21] Appl. No.: 156,471

[22] Filed: Aug. 4, 1980

[51] Int. Cl.[3] ..... B65H 17/28

[52] U.S. Cl. ..... 226/95

[58] Field of Search ..... 226/95, 97, 104

[56] References Cited

U.S. PATENT DOCUMENTS

| | | | |
|---|---|---|---|
| 2,968,702 | 1/1961 | Fay | 226/95 X |
| 3,189,239 | 6/1965 | Brumbaugh | 226/95 |
| 3,343,758 | 9/1967 | Hendal | 226/97 X |
| 3,678,216 | 7/1972 | Rousso | 226/95 |

*Primary Examiner*—Edward J. McCarthy
*Attorney, Agent, or Firm*—Michael Williams

[57] ABSTRACT

The invention comprises an accumulator for receiving and storing tenuous material, such as thin plastic strapping band, from a processing apparatus wherein the material is extruded through a die to a desired cross-sectional shape, and is thereafter subjected to further treatment, such as stretch heating, compression, annealing and the like, prior to being wound on a winder spindle for storage or transportation. The accumulator comprises a long tube having an entrance positioned adjacent to the moving band prior to its arrival at the winder spindle, and includes an eductor apparatus positioned adjacent to the exit end of the accumulator and adapted to draw air into the accumulator entrance and consequently suck the band into the entrance end of the accumulator and into the accumulator a predetermined amount to store a quantity of band so that processing of the band may continue while feed of the band to a spindle is interrupted to permit removal of a full reel and assembly of an empty reel. The rush of air into the accumulator tube will cool the band so that it may be wound on a reel at ambient temperatures.

11 Claims, 6 Drawing Figures

23
23.1
23.2
24
B
50
51
52
53
54
55
56
57
58
59
60
6
16
17
18
19
C

ACCUMULATOR FOR TENUOUS MATERIAL

BACKGROUND AND SUMMARY

Various apparatus has been heretofore used to accumulate enough of a formed tenuous material, such as a plastic or metallic strapping band, a plastic or metallic monofilament, or plastic tubing, such as Tygon tubing, so that the production line need not be halted when feed to a full reel is interrupted to remove and replace the reel.

Presently known to applicant is a looper pit at the end of the product-forming apparatus, into which the product falls. The difficulty with this accumulator system is that it is not practical to dig a deep enough pit and therefore the band begins to pile up on itself and is subject to tangling.

Another accumulator known to applicant (and still in use) consists of a festoon of rolls (as in the paper industry) wherein sets of upper and lower rolls are relatively movable vertically to establish longer paths therebetween for storage of band thereon. This is expensive, requires valuable factory space and is difficult to thread.

Another known prior device required feeding of the formed band into the top of a large container wherein the band is stored layer upon layer, and is cooled by cooling apparatus cooperable with the container. The band is withdrawn from the bottom of the container for coiling on a winder reel. This type of accumulation required a large space-consuming container and was subject to tangling of the band.

Another prior device (still in use) required feeding of the band back and forth onto the entry end of a belt conveyor to store a quantity of band on the conveyor, the band being removed from the exit end of the conveyor and fed to the winder reel. This also requires a great deal of factory space and was subject to tangling of the band, and further offers no real means to cool the band except by exposure to the surrounding atmosphere. Tangling of the band is very undesirable since the tangles sometime do not come out and result in knots. In the case of a knot, the production line must be halted so that the knot may be cut out, and this results in scrapping of the band wound in advance of the knot.

My invention provides an accumulator comprising a tube which occupies very little factory floor space since the tube inclines upwardly from its band receiving end, and has a long portion disposed near or along the roof area of the factory space.

An eductor causes air at high velocity to be drawn inwardly of the tube at the band receiving end so that the band is sucked into the tube and extends throughout a great length thereof. Thus, the band is not only accumulated within the tube but the rush of air through the tube rapidly cools the band to ambient temperature.

Cooling of the band from processing temperature to ambient temperature is very important since the band shrinks as it cools and if it is wound in warm condition on a winder reel, it will shrink as it cools on the reel and will cause camber in the band, or the outer layers may otherwise deform the inner layers.

DESCRIPTION OF THE DRAWINGS

In the drawings accompanying this specification and forming a part of this application, there are shown, for purpose of illustration, embodiments which my invention may assume and in these drawings.

DESCRIPTION OF THE PREFERRED EMBODIMENT

Figure 1:
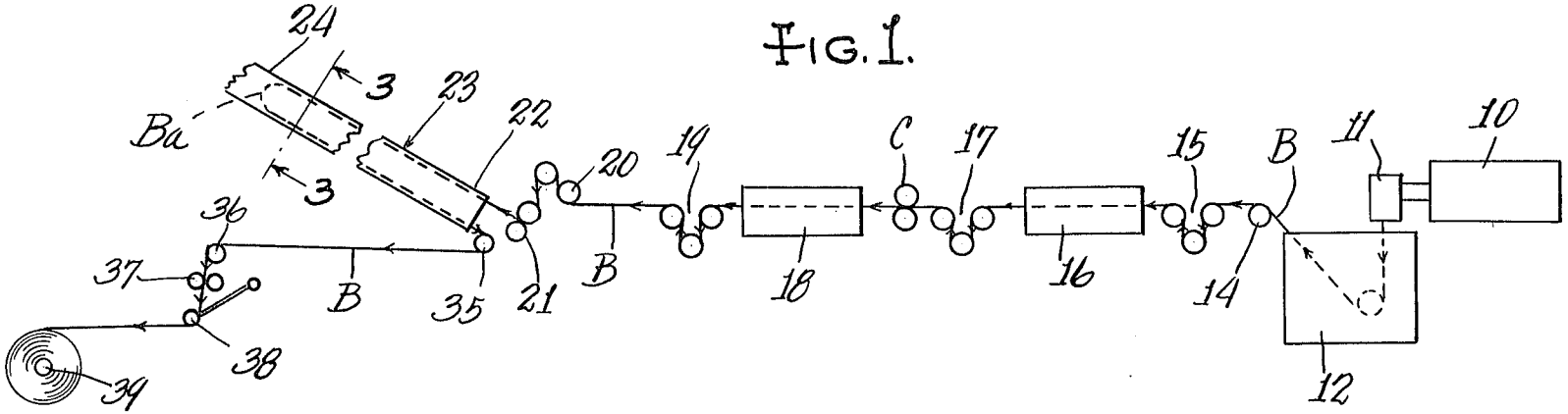
FIG. 1 is a generally schematic view showing the process of forming a particular type of strapping band, an accumulator being fragmentally shown.

In FIG. 1 the barrel 10 of a conventional plastic extruder is shown in communication with its die 11. The plastic material, in warm, flowable condition, is forced through the opening of the die in well-known manner to form a plastic strapping band B having a cross section in conformity with the die opening. The extruded band is run through a quenching bath 12, which may be cool water, to immediately give it enough body for subsequent operations.

Some of the apparatus for treating the strap may not be required, depending upon the type of band it is intended to produce. The apparatus herein disclosed is used to produce a strapping band of the type shown in U.S. Pat. No. 3,746,608 issued July 17, 1973, to Mitsuhiro Takahashi.

From the quenching bath, the band passes around a guide roll 14 and through a set of Godet rolls 15 which pull the band but do not exert any compressive forces thereagainst. The band next passes through a stretch heating apparatus 16 wherein the band is passed through heated water or air to raise its temperature so that it may be longitudinally stretched between the Godet rolls 15 at the entrance end of the heating apparatus 16 and a similar set of rolls 17 at the exit end of the heating apparatus to uniaxially orient the band in a longitudinal direction to give it high tensile strength.

From the Godet rolls 17 the band passes through a set of embossed compression rolls C to permanently indent the band and provide it with resistance to longitudinal splitting. Since the band has been stretched and compressed, it is subject to work hardening, and therefore it is passed through an anneal heating apparatus 18 which may contain hot water at about 211 degrees Fahrenheit (about 100 degrees Centigrade).

Figure 2:
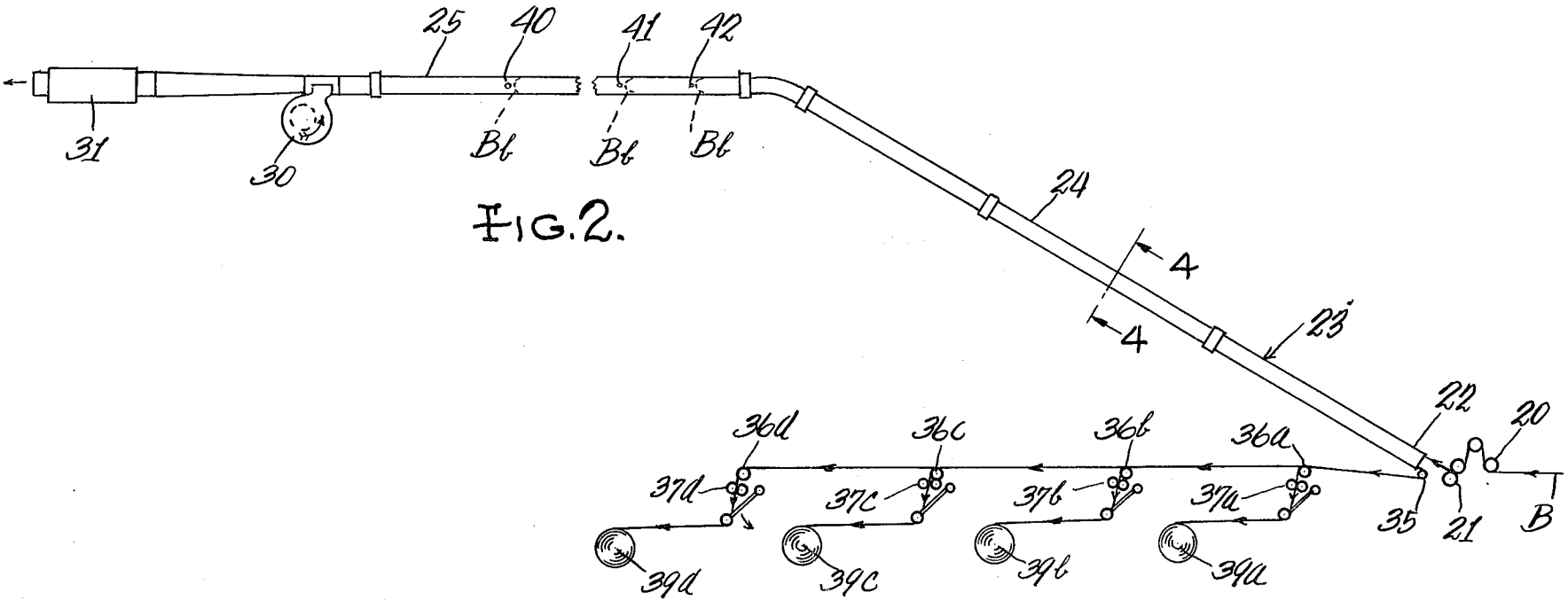
FIG. 2 is a small-scale representation of an accumulator of my invention, shown in cooperation with a plurality of winder spindles.

From the heating apparatus 18 the band passes over another set of Godet rolls 19 and over guide rolls 20 and through the bight of a set of driven feed rolls 21 which are positioned adjacent to the inlet 22 of an accumulator tube 23. As seen in FIGS. 1 and 2, the tube 23 has a portion 24 which inclines upwardly from the inlet 22 and joins with a horizontal portion 25 which may be supported from the ceiling of the building which houses the band-forming apparatus.

The accumulator tube 23 is of considerable length, and in the embodiment disclosed in FIG. 2, the length of the inclined portion 23 and 24 of the tube is about 20 feet (about 6.1 meters) and the length of the horizontal portion 25 is about 220 feet (about 67 meters). It will be appreciated that the above lengths may vary, depending upon building size and height. The accumulator tube 23 need not take the form shown in FIG. 2 and in fact may be entirely rectilinear and extend vertically, even through the building roof, if sufficient length is required. Because of the length of the accumulator tube portions 24,25 such portions are preferably made in sections which are joined to provide a smooth continuation of the interior surfaces of the sections.

An eductor 30 is inserted in the horizontal portion 25 of the accumulator tube 23 near the exit end therof. The eductor may be of any commercially-available construction, such as made by Quickdraft Company, Model MH 6510 as presently employed in the disclosed embodiment. The eductor is operable to draw room air into the inlet 22 of the accumulator tube 23 and expel it through its exit end. Preferably, a discharge silencer 31 is connected to the exit end of the tube 23 to reduce the noise of the exiting air. In the illustrated embodiment the eductor 30 draws air into the inlet 22 of the accumulator tube 23 at about 1200 feet per minute (about 365.85 meters per minute) and without a silencer the exhaust noise would be extremely objectionable. The great inrush of air creates a suction at the tube inlet 22 and the band which is thin and light, is sucked into the tube and tends to follow the flow of air.

As seen in FIG. 1 the stored strapping band B leaves the accumulator inlet 22 and passes over idler rolls 35 and 36 and through the bight of a set of winder tension control rolls 37, around a dancer roll 38 and to the winding spindle 39. The spindle may support a reel, a chuck or a core held by the chuck, upon which the band is wound, a suitable level-wind device (not shown) being provided to evenly wind the band on the reel. The rolls 37 and the spindle 39, are driven by respective variable speed motors (not shown but of any suitable commercially available type). The dancer roll 38 maintains a slight tension on the band as it passes to the winder spindle.

Figures 3, 4, 5, 6:
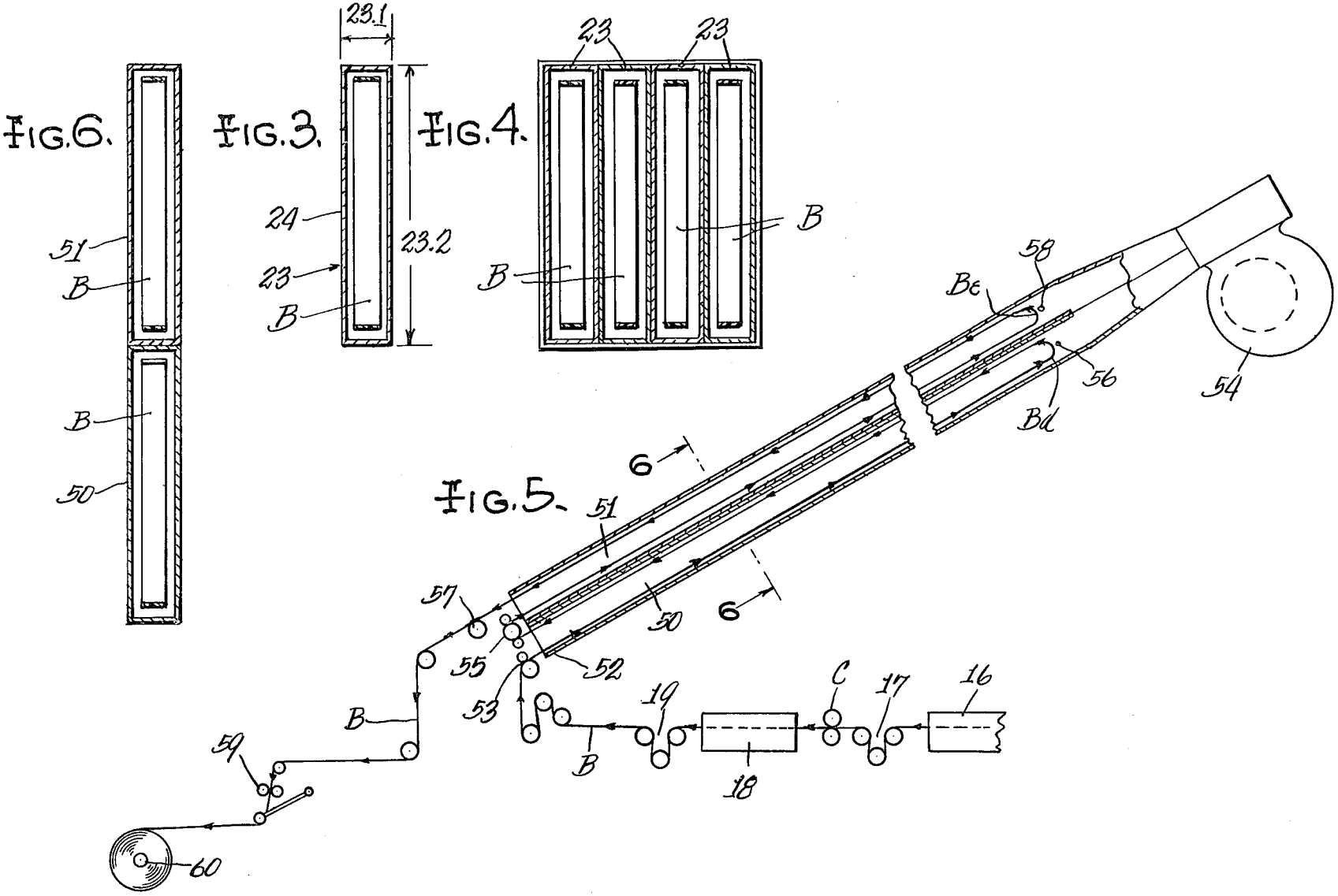
FIG. 3 is an enlarged transverse sectional view corresponding to the line 3—3 of FIG. 1.
FIG. 4 is an enlarged transverse sectional view corresponding to the line 4—4 of FIG. 2.
FIG. 5 is a fragmentary view, partly in section, showing a "piggy-back" arrangement of tubes for receiving strapping band to be cooled and accumulated.
FIG. 6 is an enlarged transverse sectional view corresponding to the line 6—6 of FIG. 5.

The speed of the tension control rolls 37 may be reduced, as compared to line speed of the feed rolls 21, so that a slack in the band appears at the inlet 22 of the accumulator tube 23. This will cause the band to be sucked inward of the tube 23 in loop form, as shown by the dotted lines Ba in FIG. 1. The tube has a rectangular cross section, as shown in FIG. 3, and the inrush of air into the accumulator 23 will cause the band parts extending from opposite ends of the bight Ba to lie adjacent to the inner surfaces of the narrower parts of the tube. The width dimension 23.1 of the tube is chosen to accomodate a band of a maximum width which may vary between predetermined limits. Usually the tube width 23.1 bears a ratio of about 1 to 6 with respect to the tube depth 23.2 to provide a cross section effective to receive the band.

In some cases the band processing apparatus provides a wide band which is subsequently slit into a plurality of narrower-width band sections, or the apparatus may actually form a plurality of bands of narrow width, with such sections in either case being delivered to a position adjacent to the entry end of the accumulator. FIGS. 2 and 4 show a construction which will accomodate four band sections and, as seen in FIG. 4, four tubes 23, each shown in FIG. 3, are bound together to receive respective band sections. Near the inlets 22 of the four tubes, the bands are spread apart laterally by suitable guide means (not shown) to align the band sections with respective tube inlets 22. Air is drawn in through all four inlets by an eductor common to all four tubes.

As seen in FIG. 2 four spaced winder spindles **39*a*, 39*b*, 39*c* and 39*d* are provided for the four bands. As a band leaves its accumulator tube, it passes around an idler roll 35 and is fed around a respective one of four idler rolls 36*a*, 36*b*, 36*c* and 36*d*, to respective tension control rolls 37*a*, 37*b*, 37*c* and 37*d***, and to a respective winder spindle. Each band is independent of the other, and the bands are accumulated in a respective tube to permit removal of a fully-wound core, without affecting the other bands.

In operation, with the winder tension control rolls 37 running at a slower speed than the feed rolls 21, band will be sucked into the inlet 22 of the accumulator tube and will be drawn upwardly into the inclined tube portion 24 and into the horizontal tube portion 25, and since these portions are quite long, a considerable amount of band will be accumulated.

In the embodiment herein disclosed the horizontal tube portion 25 has three position detection devices, such as three electric-eye devices 40, 41 and 42, in spaced-apart relation. The devices 40 and 41 control switches (not shown) which will regulate the speed of the motor of the winder tension control rolls 37 to an amount higher than the speed of the feed rolls 21 so that the band is at "draw-down" speed, that is, a speed wherein more band is withdrawn from the accumulator tube 23 than is fed into it. The device 42 controls a switch (not shown) which will regulate the speed of the motor of the winder tension control rolls 37 to an amount slower than the speed of the feed rolls 21 so that the band is at "fill speed," that is, more band is fed into the accumulator 23 than is withdrawn from it.

In the case of "fill speed" the band is fed into the accumulator tube until the bight Bb thereof reaches the electric eye device 41, whereupon the speed of the control rolls 37 is increased to "draw down" the band. "Draw down" is continued until the bight Bb of the band reaches the electric eye device 42 whereupon the speed of the control rolls 37 is decreased to "fill speed," and the action continues between the electric-eye devices to shift the bight of the band between "full speed" and "draw down" speeds. It will be appreciated that any commercially available position detector devices, other than the electric-eye devices, may be used to control band accumulation, such as mechanically- or electrically-operated limit switches, and the like. Further, one of the devices 41 or 42 may be eliminated and the remaining one may be under control of a time delay device (not shown but of commercially-available type) to effect activation of "draw down" or "fill speed" after the band bight has passed the remaining device a predetermined period of time.

When the reel, such as the reel 39 shown in FIG. 1, has its capacity of band wound thereon, its drive and the drive for the control rolls 37 are stopped, and the band is severed just in advance of the reel, and the reel is removed from the winding spindle and another reel is positioned on the spindle and the band secured to it. During the time the full reel is removed from, and another one replaced on, the winding spindle, the control rolls 37 are stopped so that band is accumulated in the tube 23. The apparatus has been so designed that the rolls 37 may be stopped, the band severed and the reel removed from the winding spindle and another one replaced before an undue amount of band has been accumulated in the tube 23. If too much band accumulates, it might reach as far back as the eductor 30 and become hopelessly tangled. To avoid this, when the bight Bb of the accumulated band passes the detector device 41 and reaches the detector device 40, the drive for the control rolls 37 is immediately started at "draw down" speed and band is fed from the rolls and onto the floor if for some reason the band has not been connected to an empty reel and the spindle for it driven.

Since such a great length of band is stored within the accumulator and withdrawn therefrom in regulated amount, the rush of air at ambient temperature through the tube and over the band stored therein will rapidly cool the band to ambient temperatures so that it may be wound on a reel without adverse effects.

DESCRIPTION OF OTHER EMBODIMENT

In FIGS. 5 and 6, an embodiment of the invention is disclosed which is adapted to conserve even more factory space since the accumulator extends upward from the end of the band processing line and over the latter.

The embodiment comprises two tubes 50 and 51 held together in "piggy back" relation, as seen in FIG. 6. The inlet end 52 of tube 50 is disposed in adjoining relation with the feed rolls 53, and both tubes have their exit ends connected to an eductor device 54 to cause an inrush of air into their inlet ends. Thus, the band is sucked into the tube 50. A position detector device 56 may be disposed to limit movement of the band bight Bb in a directin toward the eductor.

The band passes through the driven nip rolls 55 and a nearby idler roll 57 so that it will be sucked into the tube 51. A position-detector device 58 may be positioned to limit movement of the band bight Be in a direction toward the eductor. Position detectors, such as previously described, may be used to determine the amount of band stored within the accumulator tube 51, such detectors cooperating as before with the drive rolls 59 which are positioned in advance of the winding spindle 60. The embodiment shown in FIGS. 5 and 6 permits storage and cooling of a long length of band in a limited amount of space.

I claim:

1. An accumulator for storing plastic strapping band and being adapted for use in conjunction with a line for processing plastic material into band form, said accumulator comprising, an elongated tube having an inlet disposed adjacent to the exit end of said processing line at which end said band is in form for passage to a winding mechanism, and means creating a rush of air into said inlet end, through said tube and outwardly from an exit end thereof, the inrush of air sucking the band in loop form into said tube.

2. The construction according to claim 1 wherein said processing line is supported on the floor of a building, said tube having a component inclining upwardly from the end of said processing line and merging with a horizontally-disposed tube component which is disposed adjacent to the ceiling of said building so as not to interfere with floor space below said horizontal component.

3. The construction according to claim 2 wherein said winding mechanism is supported from the floor of said building and adjoins the said end of said processing line, said upwardly-inclined component of said tube overlying said winding mechanism.

4. The construction according to claim 2 wherein said upwardly-inclined component of said tube overlies said processing line.

5. The construction according to claim 1 wherein a plurality of bands in side-by-side relation issue from said processing line, said accumulator comprising a plurality of tubes in side-by-side relation, each tube adapted to receive a respective band.

6. The construction according to claim 1 wherein said accumulator comprises a pair of tubes arranged in piggy-back relation, the band from said processing line being sucked into one tube and issuing from the latter and sucked into the other tube, the band from said other tube then passing to said winding mechanism.

7. The construction according to claim 6 and further including position-sensing means for limiting the amount of band in each of said pair of tubes.

8. An accumulator for use with a processing line which processes plastic strapping band, and a driven winding spindle for winding finished band on a reel, said accumulator comprising an elongated tube having an inlet end adjacent to a path travelled by said finished band on its way from said processing line, means creating a rush of air into said inlet end, through said tube and outwardly from an exit thereof, the inrush of air sucking the band in loop form into said tube, a first set of drive rolls acting on said band to tend to push a leg of said loop form into said tube, a second set of drive rolls acting on said band to tend to pull the other leg of said loop form from said tube, and means controlling the drive of said first and second set of drive rolls to control the amount of band within said tube.

9. The construction according to claim 8 and further including position-sensing means adapted to sense the position of the bight of said loop form at spaced places within said tube and operating said control means accordingly.

10. The construction according to claim 9 and further including an eductor device at said tube exit adapted to create said inrush of air, a position-sensing means being located in advance of said eductor device and operable to sense the bight of said loop form when said bight reaches said sensing means and thereby effect operation of said control means to increase the speed of said second set of drive rolls to tend to pull more band from said tube than is admitted thereto.

11. An accumulator for storing thin, light-weight tenuous material, comprising, an elongated tube having an inlet end disposed adjacent to the path of travel of said material, said tube having a component inclining upwardly from its inlet end and merging at its upper end with a horizontally-disposed component, and means creating a rush of air into said inlet end, through said tube and outwardly from an exit thereof, the inrush of air sucking the band in loop form into said tube.

* * * * *